United States Patent [19]

Kunii

[11] Patent Number: 4,768,621

[45] Date of Patent: Sep. 6, 1988

[54] ELEVATOR SYSTEM

[75] Inventor: Kazushi Kunii, Inazawa, Japan

[73] Assignee: Mitsubishi Denki Kabushiki Kaisha, Tokyo, Japan

[21] Appl. No.: 896,244

[22] Filed: Aug. 14, 1986

[30] Foreign Application Priority Data

Aug. 16, 1985 [JP] Japan ..... 60-180239
Aug. 20, 1985 [JP] Japan ..... 60-182694

[51] Int. Cl.[4] ..... B66B 9/02
[52] U.S. Cl. ..... 187/25; 254/98
[58] Field of Search ..... 187/24, 25, 17, 19, 187/8.69; 254/98, 100, 103; 74/424.8 R

[56] References Cited

U.S. PATENT DOCUMENTS

| | | | |
|---|---|---|---|
| 1,026,650 | 5/1912 | Bloom | 187/25 X |
| 1,563,792 | 12/1925 | Rickard | 187/24 |
| 2,802,549 | 8/1957 | Izquierdo et al. | 187/25 |
| 3,468,401 | 9/1969 | Letz | 187/25 |
| 3,881,575 | 5/1975 | Manaugh | 187/25 |
| 4,051,923 | 10/1977 | Blanchette et al. | 187/25 |
| 4,287,967 | 9/1981 | Perkins | 187/24 |
| 4,548,298 | 10/1985 | Born | 187/25 |
| 4,592,450 | 6/1986 | Schaffer | 187/20 X |

FOREIGN PATENT DOCUMENTS

| | | |
|---|---|---|
| 442061 | 11/1969 | Australia . |
| 5746576 | 8/1955 | Japan . |
| 5746577 | 9/1955 | Japan . |
| 8200453 | 2/1982 | PCT Int'l Appl. . |
| 1142520 | 2/1969 | United Kingdom . |
| 1478753 | 7/1977 | United Kingdom . |

*Primary Examiner*—Joseph J. Rolla
*Assistant Examiner*—Nils Pedersen
*Attorney, Agent, or Firm*—Leydig, Voit & Mayer

[57] ABSTRACT

A compact and simple elevator system is provided which requires no counterweight and no machine room, and which is most suitable for installation in small buildings such as private homes. The elevator system comprises: a hoistway; an elevator car accommodated in the hoistway and movable in the vertical direction; a screw shaft vertically disposed in the hoistway and having a screw thread formed on the outer peripheral surface thereof; a rotary element mounted on the elevator car and adapted to be threadedly engaged with the screw shaft; a drive source mounted on the elevator car for driving the rotary element to rotate; and a mechanism for restraining the rotation of the screw shaft at least in the normal operating condition of the elevator system, whereby when the rotary element is driven to rotate by means of the drive source, it is caused to displace vertically along the screw shaft thereby to move the elevator car in the vertical direction. An emergency operation device may be provided which is adapted to be connected with the screw shaft in an emergency situation for turning the screw shaft so that the rotary element threadedly engaged with the screw shaft is caused to displace vertically along the screw shaft thereby to move the rotary element and hence the elevator car in the vertical direction.

21 Claims, 4 Drawing Sheets

ELEVATOR SYSTEM

BACKGROUND OF THE INVENTION

1. Field of the Invention

This invention relates to an elevator system particularly adapted for use in small buildings such as private homes.

2. Description of the Prior Art

In recent years, persons of advanced age have been increasing at a rapid rate in Japan and other places in the world, and along with this aging of society has come an increase in the demand that a compact elevator system be installed in two- or three-storied private homes. However, conventional elevator systems have been developed in accordance with demands for large-sized elevator systems in large office buildings, cooperative housing, or the like and if the large-sized conventional elevator systems suitable for these large buildings are miniaturized for use with small-sized buildings such as private homes, there will be many inconveniences particularly from the view points of installation space efficiency, production economy and maintenance costs, etc. Specifically, many elevator systems in general employ a well-bucket type lifting system in which an elevator car and a counterweight are connected to each other by a main or hoisting rope, but this type of lifting system requires a relatively greater installation space for the counterweight as compared with the elevator car, and hence is not suitable for small-sized elevator systems.

On the other hand, there has been known a drum-type elevator system which does not use any counterweight as described, for example, in Mitsubishi Denki Technical Information, volume 57, number 11, page 7(745), FIGS. 2 and 4, issued on Nov. 25, 1983. This drum-type elevator system is constructed such that an elevator car is caused to move vertially by winding and rewinding a hoisting rope around a drum without use of any counterweight. Thus, a drum-type elevator system employing no counterweight can be produced with a small size and is suitable for installation in applications with limited available space.

Although in the above-described conventional elevator system, no counterweight is employed, a machine room for installation of an electric motor for driving a drum is required instead, and accordingly, it is essential to provide a machine room in a home installation which thereby takes up valuable portion of the relatively small space available in most homes, making it difficult to effectively utilize available space.

SUMMARY OF THE INVENTION

In view of the above, the present invention has the objective to obviate the above-described problems of the prior art and has for its main object to provide a compact and simple elevator system which requires no counterweight and machine room, and which is most suitable for installation in private homes.

In order to achieve the above object, according to the present invention, there is provided an elevator system which comprises:

a hoistway;

an elevator car accommodated in the hoistway and movable in the vertical direction;

a screw shaft vertically disposed in the hoistway and having a screw thread formed on the outer peripheral surface thereof;

a rotary element mounted on the elevator car and adapted to be threadedly engaged with the screw shaft;

a drive source mounted on the elevator car for driving the rotary element to rotate; and means for restraining the rotation of the screw shaft at least in the normal operating condition of the elevator system, whereby when the rotary element is driven to rotate by means of the drive source, it is caused to displace vertically along the screw shaft thereby to move the elevator car in the vertical direction.

The above and other objects, features and advantages of the present invention will become apparent from the following detailed description of a few presently preferred embodiments of the invention when taken in conjunction with the accompanying drawings.

DESCRIPTION OF THE PREFERRED EMBODIMENTS

Now, the present invention will be described with reference to a few presently preferred embodiments thereof as illustrated in the accompanying drawings.

FIGS. 1 through 5 show an elevator system constructed in accordance with a first embodiment of the present invention.

Figure 1:
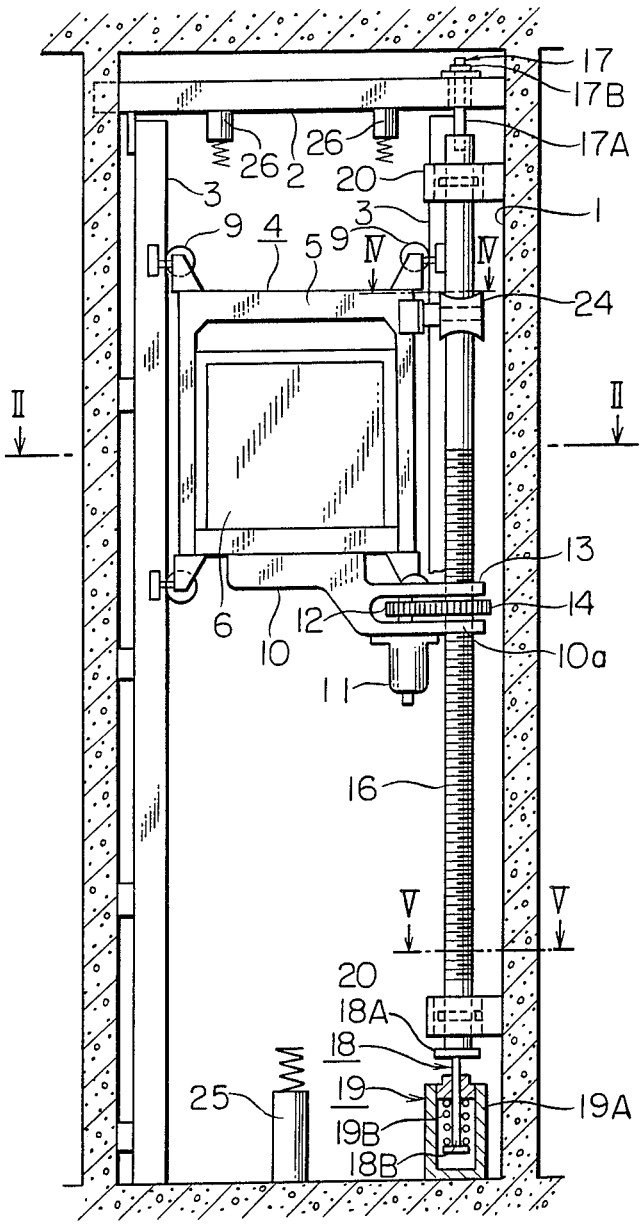
FIG. 1 is a vertical cross sectional view showing a elevator system in accordance with one embodiment of the present invention.
Figure 2:
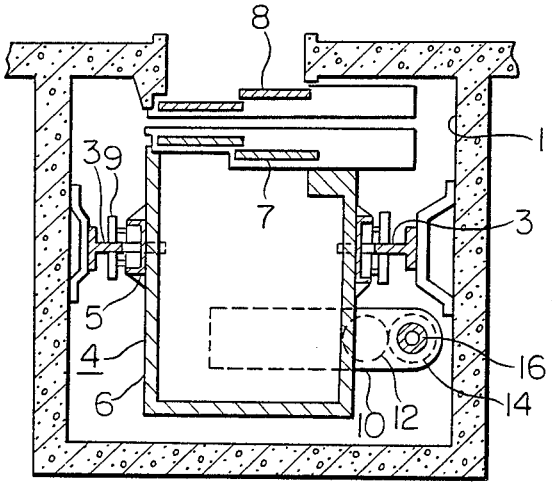
FIG. 2 is a cross sectional view taken along the line II—II in FIG. 1.

In FIG. 1, the elevator system as illustrated includes a vertically extending hoistway 1 of rectangular cross section on the upper wall of which a support beam 2 is horizontally mounted. A pair of guide rails 3 are vertically disposed in the hoistway 1 and each have their upper end mounted on the support beam 2 ad their bottom face supported on the bottom surface of the hoistway 1. Disposed between the guide rails 3 is an elevator car 4 including a car frame 5 and a cabin 6 supported by the car frame 5. The car cabin 6 has an entrance adapted to be closed by a car door 7. A hall door 8 corresponding to the car door 7 is provided for closing a hall opening in the hoistway 1.

The car frame 5 has four groups of guide rollers 9 mounted thereon, each group of guide rollers including three rollers rotatably mounted on the car frame 5 so as to roll on and along the top surface and the side surfaces of the respective guide rails 3 for guiding the vertical movements of the elevator car 4. Disposed at the rear portion of the elevator car 4 is an arm which extends toward one side of the car 4 and which is secured to the bottom surface of the car frame 5. An electric motor 11 is mounted on a horizontally extending portion 10*a* of the arm 10 and has a rotary shaft to which a pinion 12 is fixedly secured.

Figure 3:
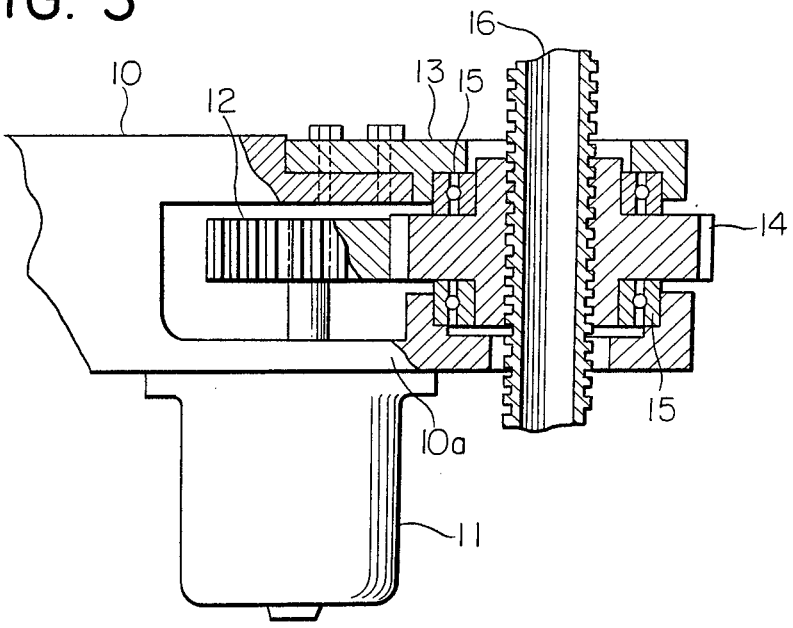
FIG. 3 is a partially cutaway side elevational view, on an enlarged scale, of a part of a rotary element and its related portions shown in FIG. 1.

As best seen from FIG. 3, the arm 10 has an integral projection 13 horizontally outwardly extending in a vertically-spaced parallel relation with the horizontally extending portion 10*a* thereof between which a rotary element or toothed gear wheel 14 is disposed. The rotary element 14 is rotatably mounted on the horizontal projection 13 and the horizontally extending portion 10*a* of the arm 10 and is in meshing engagement on its outer periphery with the pinion 12 on the rotary shaft of the electric motor 11. The rotary element 14 has an internally threaded axial bore formed therethrough.

A screw shaft 16 is vertically disposed in the hoistway 1 and is made of a tubular material having a male or external thread formed on its outer peripheral surface substantially along the length of the shaft 16 corresponding to the vertical reciprocating stroke of the elevator car 4, the screw shaft 16 being in threaded engagement on its outer periphery with the threaded axial bore in the rotary element 14.

Turning again to FIG. 1, the screw shaft 16 is supported at its upper end by the support beam 2 through an upper support means 17 which includes an upper support rod 17A fixedly secured to the upper end of the screw shaft 16 and extending therefrom loosely through the support beam 2, and a nut 17B threaded over the support rod 17A. Also, the screw shaft 16 is supported at its lower end by the bottom surface of the hoistway 1 through a lower support means 18 having a tensioning means 19. The lower support means 18 comprises a rod fixedly secured to and extending downwardly from the lower end of the screw shaft 16. The rod 18 has an upper enlarged end 18A larger in diameter than the screw shaft 16 and a lower enlarged end 18B. The tensioning means 19 comprises a box 19A which is mounted on the bottom surface of the hoistway 1 and into which the rod 18 secured to the lower end of the screw shaft 16 extends, and a tension spring 19B in the form of a coiled compression spring accommodated in the box 19A and disposed under compression between the lower enlarged end 18B and a top closure of the box 19A in a surrounding relation with the rod 18 for biasing the rod 18 and hence the screw shaft 16 in the downward direction. In this manner, the screw shaft 16 is supported at its opposite ends by the support beam 2 and the bottom surface of the hoistway 1 through the intermediary of the upper support means 17, the lower support means 18 and the tensioning means 19.

Figure 5:
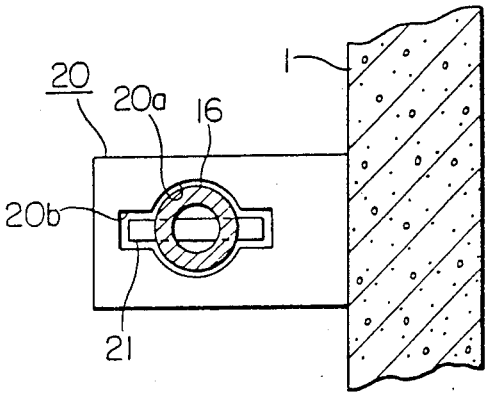
FIG. 5 is a cross sectional view taken along the line V—V in FIG. 1.

As is clear from FIG. 5, a pair of upper and lower engagement members 20 are fixedly mounted on one side wall of the hoistway 1 at locations near to but spaced a certain distance away from the upper and lowr ends of the screw shaft 16. These engagement members 20 are of the same construction and each has an axial hole 20*a* through which the screw shaft 16 loosely extends, and a pair of aligned grooves 20*b* disposed in a diametrically opposite relation with each other for engaging the opposite ends of a pin 21 which diametrically extends through the screw shaft 16.

Figure 4:
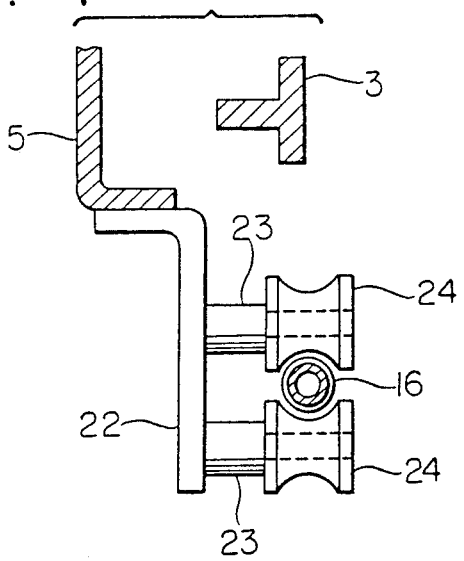
FIG. 4 is a cross sectional view taken along the line IV—IV in FIG. 1.

As illustrted in FIG. 4, fixedly attached to the car frame 5 is a support arm 22 having a pair of support shafts 23 fixedly secured thereto. Guide members 24 eachin the form of a roller having at its outer periphery an annular groove of arc-shaped cross section are rotatably mounted on the respective support shafts 23. The screw shaft 16 is disposed between the guide rollers 24 with a certain definite clearance formed between the outer peripheral surface of the screw shaft 16 and the annularly grooved outer peripheral surface of each guide roller 23.

Reference numerals 25 and 26 designate a lower buffer and two upper buffers, respectively, mounted on the bottom surface and the top surface of the hoistway 1 for damping the downward and upward movements of the elevator car 4 when stopping.

With the elevator system as constructed in the above manner, the screw shaft 16 is resiliently biased downward under the action of the tensioning spring 19B so as to bring the nut 17B threaded over the support rod 17A into abutting engagement with the support beam 2 whereby the screw shaft 16 is resiliently supported at its upper and lower ends by the upper support means 17, the lower support means 18 and the tensioning means 19. Thus, since the support rod 17A loosely extends through the support beam 2, the screw shaft 16 is displaceable in the upward direction while compressing the tensioning spring 19B.

In operation, when the electric motor 11 is actuated, the rotary element 14 in mesh with the pinion 12 is caused to rotate so that it, being in threaded engagement with the screw shaft 16, is forced to move along the screw shaft 16 in the vertical direction, thereby causing the upward and downward movements of the elevator car 4. During the vertical movements of the elevator car 4, the car 4 is guided by the guide rails 3, through the guide rollers 9 so that the threaded surfaces onthe rotary element 14 and the screw shaft 16 are subjected solely to thrust forces, thus preventing any moment force produced by unbalanced loading of the elvator car 4 from being applied to the screw shaft 16. As a result, the screw shaft 16 has only to withstand vertical loads and hence can be reduced in diameter to a value just enough to withstand vertical loads.

In order to prevent the overtravel of the elevator car 4 at the end of the upward and downward strokes, there are provided appropriate stopping devices (not shown), as employed in a conventional elevator system, so that the power supply to the electric motor 11 is stopped upon actuation of the stopping devices.

On the other hand, in cases where the upward or downward movement of the elevator car 4 is stopped at a location intermediate the adjacent elevator halls or floors for some reason such as, for example, damage to the building, an overcurrent passing through the electric motor 11 is detected by an appropriate sensor (not shown) and the power supply to the motor 11 is interruptted. In this case, the arrangement is such that until such a power interruption is actually made, a axial force applied to the screw shaft 16 is prevented from acting on the screw shaft as a compressive force. Specifically, when an excessively great downward thrust force is applied to the screw shaft 16 upon suppression of the upward movement of the elevator car 4, it is supported by the upper support means 17 instead of the lower support means 18 so that an overload applied to the screw shaft 16 acts as a tensile force. On the other hand, when the electric motor 11 continues to rotate after suppression of the downward movement of the elevator car 4, the screw shaft 16 is slightly displaced upward while compressing the tensioning spring 19B and then the enlarged stop 18A at the lower end of the screw shaft 16 is placed into abutting engagement with the lower engagement member 20, whereby an overload on the screw shaft 16 also acts as a tensile force. As a result, in either case, the screw shaft 16 is subjected solely to tensile forces and there is no danger of the screw shaft 16 being buckled.

As the rotary element 14 rotates, frictional forces will be produced on the threaded surfaces of the axial bore in the rotary element 14 and of the outer peripheral surface of the screw shaft 16 which forces act to rotate te screw shaft 16. In this case, however, such a rotation of the screw shaft 16 is securely prevented by the engagement of the pins 21, extending diametrically through the screw shaft 16, with the corresponding grooves 20b, 20b in the engagement members 20.

In the event that the screw shaft 16 is forced to extend downward upon application thereto of the weight of the elevator car 4, the pins 21 are permitted to move downward in the vertical direction within the grooves 20*b*, in the rotary elements 20. Should the elevator car 4 not stop at the lowermost floor while compressing the lower buffer 25 to a lower limit position, the screw haft 16 is caused to displace upward until the enlarged stop 18A at the lower end of the screw shaft 16 abuts against the lower engagement member 20, as referred to above. During this upward movement of the screw shaft 16, the pins 21 move upward within the grooves 20*b* in the engagement members 20.

In this connection, it is to be noted that the pins 21 extend diametrically through the screw shaft 16 at locations spaced a certain distance from the extremities thereof so that the torsional torque applied to the screw shat 16 by the rotary element 14 is not transmitted to the upper support means 17. As a result, the required strength of the upper end of the screw shaft 16 including the upper support means 17 can be reduced to a value just able to withstand the tensile force applied to the screw shaft 16.

Further, although in the above-described embodiment, the pins 21 are provided at both upper and lower locations, only one of them may be sufficient to withstand the torsional force acting on the screw shaft 16 if the vertical stroke of the elevator car 4 and hence the length of the screw shaft 16 is relatively short.

Additionally, it is expected that the screw shaft 16, being arranged under tension through the action of the tensioning means 19, will vibrate upon occurrence of an earthquake. On such an occasion, when the screw shaft 16 flexes laterally due to its rolling vibration, the enlarged stop 18A at the lower end of the screw shaft 16 will bhe brought into abutting engagement with the lower engagement member 20, thus restraining the curving or flexing of the screw shaft 16. Also, the screw shaft 16 abuts against the guide rollers 24 so that lateral vibrations are restricted within the clearances between the screw shaft 16 and the guide rollers 24.

Due to the fact that the support beam 2 is mounted on the side walls of the hoistway 1 and connected with the guide rails 3, a part of the vertical force acting on the screw shaft 16 is also supported by the guide rails 3. This construction is most desirable particularly in cases where a building such as a private home, in which the elevator system of the present invention is to be installed, is designed to be of lightweight construction.

In an ordinary drum and rope type elevator, it is necessary to provide an emergency stopping device which acts, in an emergency situation, to rapidly stop the descending elevator car 4 by gripping the guide rails 3 should the elevator car 4 fall at an abnormally great speed owing to troubles in the ordinary braking system, a break in the hoisting rope or the like. In the above-described embodiment, however, the lead angle of the thread on the screw shaft 16 can be selected to be appropriately small enough that the rotation of the rotary element 14 relative to the screw shaft 16 can be restrained by the frictional force produced between the threaded surfaces of the screw shaft 16 and the rotary element 14. Thus, there is no need for any emergency stopping device or for any governor for operating the same, and it is possible not only to simplify the construction of the entire elevator system but also to substantially reduce the required installation space of the hoistway 1.

The electric motor 11, being mounted on the arm 10 below the elevator car 4, does not act on the car frame 5 as a suspended load so that the support posts of the car frame 5 need only have sufficient mechanical strength to withstand the forces acting thereon from the guide rollers 9, and thus can be of lightweight construction.

Although in the above-described embodiment, the screw shaft 16 is suspended or loosely supported at its upper end by the support beam 2 through the upper support means 17 and tensioned at its lower end by the tensioning means 19, this arrangement can be reversed, that is the screw shaft 16 may be loosely supported at its lower end and tensioned at its upper end. Otherwise, the screw shaft 16 may be supported by being tensioned at its opposite ends.

Further, although the screw shaft 16 is disposed at the side rear portion of the elevator car 4 in this embodiment, it may also be at the rear portion or side front portion of the elevator car 4. Also, the threads on the screw shaft 16 and the rotary element 14 are not limited to square threads but may be of threads of any form, or a recirculating ball type assembly (a linear motion ball bearing) of extremely low friction may be employed in place of the threaded engagement between the screw shaft 16 and the threaded rotary element 14 so as to reduce the relatively high friction therebetween for smooth and substantially frictionless motion relative to each other.

If the car frame 5 has sufficient mechanical strength, the electric motor 11 may be mounted on the elevator car 4. In this case, it would be more convenient to maintain and/or inspect the electric motor 11.

Figure 6:
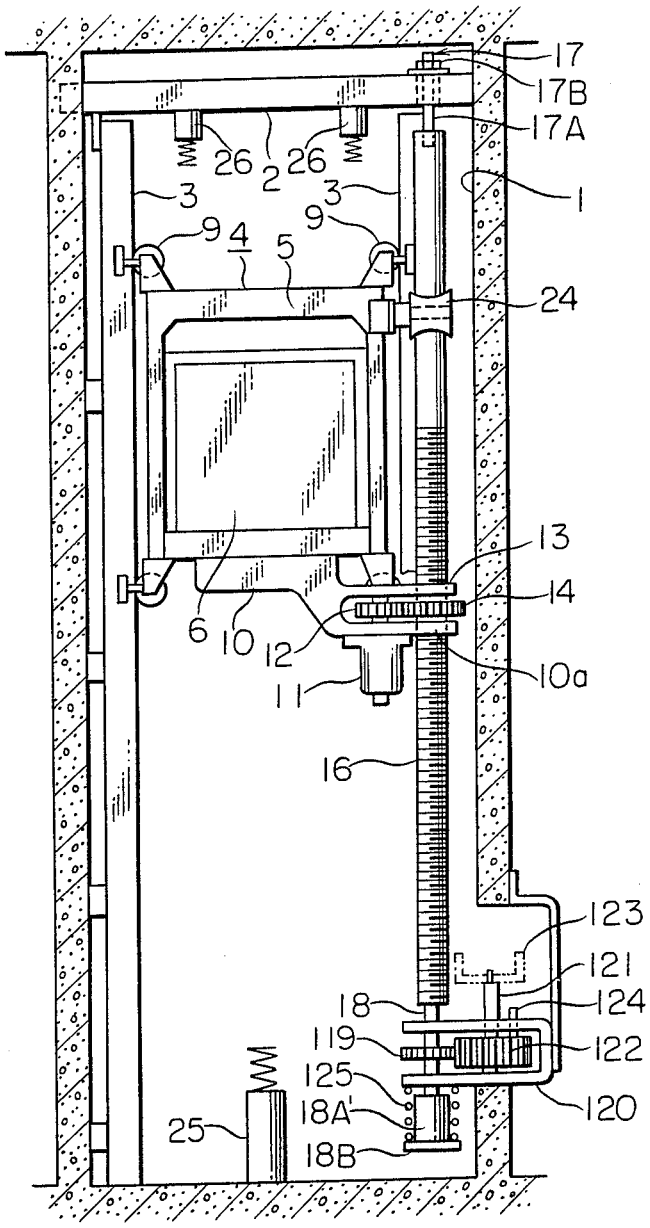
FIG. 6 is a vertical cross sectional view similar to FIG. 1, showing an elevator system in accordance with another embodiment of the present invention.

FIG. 6 shows another embodiment of the present invention which is provided with an emergency exit device adapted to be used at the time of an operational failure in the elevator system.

In this embodiment, the elevator system comprises a screw shaft vertically mounted in a hoistway, a rotary element connected with the elevator car and adapted to be threadedly engaged with the screw shaft, the rotary element being driven to rotate by means of a drive source such as an electric motor so that the rotary element is caused to displace vertically along the screw shaft thereby to move the elevator car in the vertical direction, and an operation means adapted to be manually operated to rotate the screw shaft by an external force whereby the elevator car is caused to move in the vertical direction.

Now, a more detailed description of this embodiment wil be made with reference to FIG. 6. In this figure, the same or corresponding parts are identified by the same reference numerals and characters as empolyed in FIGS. 1 through 5.

As seen from FIG. 6, a considerable portion of this embodiment is the same as that of the above-described first embodiment of the invention illustrated in FIGS. 1 through 5 except for the following construction and operation. Specifically, an elevator system of this embodiment includes, in addition to almost all components of the embodiment of FIGS. 1 through 5, a first or driven spur gear wheel 119 fixedly mounted on the lower support rod 18 intermediate the opposite ends thereof, a gear housing 120 of channel-shaped cross section which is firmly mounted on a lower portion of thehoistway 1 and through which the lower support rod 18 extends, a shaft 121 rotatably supported by and extending vertically upward through the gear housing 120, a second or driving spur gear wheel 122 fixedly mounted on the shaft 121 and adapted to be in meshing engagement with the driven spur gear wheel 119, a handle for manual operation detachably secured to the upper end of the shaft 121, a pin 124 extending through the gear housing 120 and inserted into a hole (not shown) in the driving spur gear wheel 122, and a tensioning means 125 in the form of a coiled compression spring disposed between the gear housing 120 and a lower flanged end 18B of the lower support rod 18.

With the elevator system of this embodiment as constructed in the above manner, the driving spur gear wheel 122 is fixed by means of the pin 124 to the gear housing 120 and held against rotation in the normal operating condition of the elevator system so that the driven spur gear wheel 119 and hence the screw shaft 16 are restrained from rotation. Accordingly, when the electric motor 11 is actuated, the rotary element 14 is driven to rotate through the pinion 12 in meshing engagement therewith. On this occasion, the rotary element 14, being rotated relative to the screw shaft 16, i displaced vertically along the screw shaft 16 thereby to move the elevator car 4 in the vertical direction since the rotation of the screw shaft 16 is restrained by the pin 124 as referred to above.

On the other hand, it is assumed that the elevator system has some trouble and the elevator car 4 is stopped at a location intermediate the adjacent elevator halls or floors and in such a case passengers are in the elevator cabin 6, it is desirable that the elevator car 4 be moved to the nearest elevator hall so the passengers may escape before the trouble is repaired. Such emergency escape can be effected by virtue of an emergency operation device which comprises the driven and driving spur gear wheels 119 and 122, the shaft 121 and the handle 123. More specifically, in an emergency situation, the pin 124 is removed and the handle 123 is attached to the upper end of the shaft 121. Then, by turning the handle 123, the turning force or torque is transmitted from the handle 123 to the screw shaft 16 through the shaft 121, the driving and driven spur gear wheels 122 and 119 and the lower support rod 18 so that the screw shaft 16 is caused to rotate. With rotation of the screw shaft 16, the rotary element 14 in threaded engagement with the screw shaft 16 is forced to displace vertically along the screw shaft 16 whereby the elevator car 4 is moved in the vertical direction.

In this connection, it is to be noted that the tooth width of the driving spur gear wheel 122 is greater than that of the driven spur gear wheel 119 so that the meshed engagement between these gear wheels will not be released even if the screw shaft 16is extended downward under application of the weight of the elevator car 4. In other words, it is constructed such that the axial length of engagement between the driven and driving gear wheels 119 ad 122 is greater than the allowable vertical displacement of the screw shaft 16. Should the descending elevator car 4 not stop at the lower terminal floor but rather continues downward to compress the lower buffer 25 ot the lower limit position, the screw shaft 16 will be caused, upon further continued rotation of the rotary element 14, to move upward until the enlarged-diameter stop 18A of the lower support rod 18 abuts agains tthe the gear housing 120, as described in the foregoing. In this case, however, the meshed engagement between the driving and driven spur gear wheels 122 and 119 is securely maintained.

Further, due to the fact that the screw shaft 16 is tensioned by means of the tensioning spring 125, it is contemplated that the screw shaft 16 will be forced to vibrate in a rolling manner during a earthquake. But, on such an occasion, the rolling vibrations of the screw shaft 16 will be suppressed by engagement of the lower enlarged-diameter stop 18A of the lower support rod 18 with the gear housing 120.

Although the spur gear including the driven and driving gear wheels 119 and 122 is employed for torque transmission of the emergency operating device, there may also be used other appropriate torque-transmission mechanism such as a bevel gear, a worm gear including a worm and a worm wheel, a chain transmission including sprockets and a chain belt, or the like.

As described in the foregoing, an elevator system of the present invention comprises a screw shaft vertically disposed in a hoistway, a rotary element mounted on an elevator car in threaded engagement with the screw shaft and adapted to be driven to rotate by means of a drive source, and means for restraining the rotation of the screw shaft at least in the normal operating condition of the elevator system, whereby when rotated by means of the drive source, the rotary element is caused to displace vertically along the scew shaft thereby to move the elevator car in the vertical direction. With this arrangement, there is no need for provision of a counterweight or a machine room, and thus it is possible to provide a compact and inexpensive elevator system which is most suited for installation in small buildings such as private homes.

What is claimed is:

1. An elevator system comprising:

a hoistway;

an elevator car accommodated in said hoistway and movable in the vertical direction;

a screw shaft vertically mounted in said hoistway and having a screw thread formed on the outer peripheral surface thereof and an upper end and a lower end;

means suspending said screw shaft in said hoistway from said upper end while allowing upward vertical displacement thereof;

a rotary element mounted on said elevator car and adapted to be threadedly engaged with said screw shaft;

a drive source mounted on said elevator car for rotating said rotary element;

restraining means for restraining the rotation of said screw shaft at least in the normal operating condition of the elevator system when said rotary element is driven to rotate by means of said drive source while allowing limited vertical displacement of said screw shaft, including an engagement member mounted on said hoistway and means connected to said screw shaft and held against rotation by said engagement member while being allowed to move axially, whereby said rotary element is caused to be displaced vertically along said screw shaft to move said elevator car in the vertical direction; and means engaging said lower end of said screw shaft and limiting upward movement thereof in response to a load in the upward direction on said screw shaft by said rotary element so that a load in either vertical direction on said screw shaft subjects said screw shaft solely to tensile forces.

2. An elevator system as claimed in claim 1 wherein said rotary element has an axial bore through which said screw shaft extends, said rotary element being provided on theinner surface of said axial bore with an internal thread which is engaged with the external screw thread on said screw shaft.

3. An elevator system as claimed in claim 1 wherein said restraining means comprises:

at least one engagement member mounted on said hoistway ad having an axial hole through which said screw shaft extends, said engagement member having a pair of axial grooves formed on the inner peripheral surface of said axial hole, said axial grooves being disposed in a diametrically opposite relation with each other to extend along the axial length of said engagement member; and at least one pin diametrically extending through said screw shaft and having its opposite ends engaged in said axial grooves in said engagement member and held against rotational movement while being movable axially to restrain the rotation of said screw shaft while allowing limited vertical displacement of said screw shaft relative to said engagement member.

4. An elevator system as claimed in claim 3, wherein said means for restraining the rotation of said screw shaft at least in the normal operating condition of the elevator system comprises two pairs of engagement members and axially movable pins respective pairs of which are arranged at the upper and lower portions of said screw shaft.

5. An elevator system comprising:

a hoistway;

an elevator car accommodated in said hoistway and movable in the vertical direction;

a screw shaft vertically dispsoed in said hoistway and having a screw thread formed on the outer peripheral surface thereof;

a rotary element mounted on said elevator car and adapted to be threadedly engaged with said screw shaft;

a drive source mounted on said elevator car for driving said rotary element to rotate; and means for restrianing the rotation of said screw shaft at least in the normal operating condition of the elevator system, whereby when said rotary element is driven to rotate by means of said drive source, it is caused to displace vertically along said screw shaft, thereby to move said elevator car in the vertical direction, said restraining means comprising:

a first gear wheel fixedly mounted on said screw shaft;

a second gear wheel rotatably mounted on said hoistway and being in meshing engagement with said first gear wheel; and means for restraining the rotation of said second gear wheel in the normal operating condition of the elevator system so that said first gear wheel in mesh with said second gear wheel is held against rotation.

6. An elevator system as claimed in claim 5 wherein said means for restraining the rotation of said second gear wheel in the normal operating condition of the elevator system comprises:

a gear housing fixedly secured to said hoistway for housing therein sasid first and second gear wheels, said second gear wheel being rotatably mounted on said gear housing; and a pin extending through said gear housing and being adapted to be releasably engageable with said second gear wheel for restraining the rotation thereof.

7. An elevator system comprising:

a hoistway;

an elevator car accommodated in said hoistway and movable in the vertical direction;

a screw shaft vertically disposed in said hoistway and having a screw thread formed on the outer peripheral surface thereof;

a rotary element mounted on said elevator car and adapted to be threadedly engaged with said screw shaft;

a drive source mounted on said elevator car for driving said rotary element to rotate;

means for restraining the rotation of said screw shaft at least in the normal operating condition of the elevator system, whereby when said rotary element is driven to rotate by means of said drive source, it is caused to displace vertically along said screw shaft, thereby to move said elevator car in the vertical direction, and an emergencyoperation device adapted to be conected with said screw shaft in an emergency situtation for turning said screw shaft so that said rotary element threadedly engaged with said screw shaft is caused to displace vertically along said screw shaft, thereby to move said rotary element and hence said elevator car in the vertical direction.

8. An elevator system as claimed in claim 7 wherein said emergency operation device comprises:

a first gear wheel fixedly mounted on said screw shaft;

a second gear wheel rotatably mounted on said hoistway and being in meshing engagement with said first gear wheel; and means for turning said second gear wheel in an emergency situation so as to rotate said screw shaft through said first gear wheel.

9. An elevator system as claimed in claim 8 wherein said means for turning said second gear wheel in an emergency situation comprises a handle adapted to be detachably attached to said second gear wheel for rotation thereof.

10. An elevator system as claimed in claim 8 wherein said means for restraining the rotation of said screw shaft in the normal operating condition of the elevator system comprises:

said first gear wheel;

said second gear wheel;

a gear housing fixedly secured to said hoistway for housing therein said first and second gear wheels, said second gear wheel being rotatably mounted on said gear housing; and a pin extending through said gear housing and being adapted to be releasably engageable with said second gear wheel for restraining the rotation thereof.

11. An elevator system comprising:

a hoistway;

an elevator car accommodated in said hoistway and movable in the vertical direction;

a screw shaft vertically disposed in said hoistway and having a screw thread formed on the outer peripheral surface thereof;

a rotary element mounted on said elevator car and adapted to be threadedly engaged with said screw shaft;

a drive source mounted on said elevator car for driving said rotary element to rotate;

means for restraining the rotation of said screw shaft at least in the normal operating condition of the elevator system, whereby when said rotary element is driven to rotate by means of said drive source, it is caused to displace vertically along said screw shaft, thereby to move said elevator car in the vertical direction;

a support beam transversely mounted on said hoistway at its upper portion;

an upper support means for supporting the upper end of said screw shaft in a manner such that said screw shaft is prevented from downward displacement but permitted to displace in the upward direction; and a lower support means for supporting the lower end of said screw shaft in a manner such that said screw shaft is resiliently urged in the downward direction.

12. An elevator system as claimed in claim 11 wherein said supper support means comprises:

an upper support rod secured to and extending uward from the upper end of said screw shaft loosely through said support beam; and a stop attached to the upper end of said uppwer support rod and adapted to be placed into abutting engagement with said support beam for preventing the downward displacement of said screw shaft.

13. An elevator ystem as claimed in claim 11 wherein said lower support means comprises:

a lower rod secured to the lower end of said screw shaft and extending downward therefrom;

a box which is mounted on the bottom surface of said hoistway and into which said loewr rod extends; and a tensioning means disposed in said box for biasing said lower rod in the downward direction.

14. An elevator system as claimed in claim 13 further comprising an engagement member which is mounted on said hoistway at a location near the lower end of said screw shaft and through which said screw shaft extends for vertical movement, and wherein said lower rod has an enlarged stop larger in diameter than that of said screw shaft, said stop being adapted to abut, upon upward displacement of said screw shaft, against said engagement member for limiting the upward displacement of said screw shaft.

15. An elevator system as claimed in claim 11 wherein said lower support means comprises:

a lower rod secured to the lower end of said screw shaft and extending downward therefrom;

a gear housing which is mounted on said hoistway and through which said lower rod extends for vertical movement;

a tensioning meas disposed between said gear housing and the lower end of said lwoer rod for biasing said lower rod in the downwrd direction; and an enlarged stop mounted on the lower end of said lower rod and being adapted to abut, upon upward displacement of said screw shaft, against said gear housing for limiting the upward displacement of said screw shaft.

16. An elevator system as claimed in claim 15 further comprising:

a first gear wheel fixedly mounted on said lower rod and disposed in said gear housing;

a second gear wheel disposed in and rotatably supported by said gear housing and being in meshing engagement with said first gear wheel, the axial length of engagement between said first and second gear wheels being greater than the limited allowable vertical displacement of said screw shaft; and operation means for not only restraining the rotation of said second gear wheel in the normal operating condition of the elevator system so that said screw shaft is held against rotation by virtue of said first gear wheel but also turning said second gear wheel in an elevator system emergency so that said screw shaft is caused to rotate through said first gear wheel thereby to move said rotary element and hence said elevator car in the vertical direction.

17. An elevator system as claimed in claim 16 wherein said operation means comprises:

a pin adapted to extend through said gear housing so as to be releasably engageable with said second gear wheel for restraining the rotation thereof in the normal operating condition of the elevator system; and a handle adapted to be detachably attached to said second gear wheel for turning thereof in a emergency situation of the elevator car.

18. An elevator system as claimed in claim 16 wherein the tooth width of said second gear wheel is greater than that of said first gear wheel.

19. An elevator system comprising:

a hoistway;

an elevator car accommodated in said hoistway and movable in the vertical direction;

a screw shaft vertically disposed in said hoistway and having a screw thread formed on the outer peripheral surface thereof, said screw shaft having an upper end and a lower end;

means for suspending said screw shaft in said hoistway;

a rotary element mounted on said elevator car and adapted to be threadedly engaged with said scre shaft;

a drive source mounted on said elevator car for driving said rotary element to rotate;

means for restraining the rotation of said screw shaft whereby, when said rotary element is driven to rotate by means of said drive source, it is caused to displace vertically along said screw shaft, thereby to move said elevator car in the vertical direction;

said suspending means including means allowing vertical upward movement of said screw shaft and limiting downward movement thereof in response to a load in the downward direction on said screw shaft by said rotary element; and means engaging said lwoer end of said screw shaft for limiting upward movement thereof in response to a load in the upward direction on said screw shaft by said rotary element so that a load in either direction on said screw shaft subjects said screw shaft solely to tensile forces.

20. An elevator system according to claim 19 wherein said means engaging said lower end of said screw shaft includes means limiting vertical upward movement thereof to a predetermined distance in response to a load in the upward direction on said screw shaft by said rotary element, so that such a load subjects said screw shaft to a tensile force.

21. An elevator system according to claim 20 wherein said means engaging said lower end of said screw shaft includes a resilient means urging said screw shaft in the downward direction such that said screw shaft is suspended from the upper end thereof.

* * * * *